US011707691B2

(12) United States Patent
Boyce et al.

(10) Patent No.: US 11,707,691 B2
(45) Date of Patent: Jul. 25, 2023

(54) POSABLE TOY FIGURE

(71) Applicant: Hasbro, Inc., Pawtucket, RI (US)

(72) Inventors: John Douglas Boyce, Ellington, CT (US); Joel Kramer, Bristol, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 17/395,640

(22) Filed: Aug. 6, 2021

(65) Prior Publication Data

US 2021/0362066 A1 Nov. 25, 2021

Related U.S. Application Data

(62) Division of application No. 16/702,945, filed on Dec. 4, 2019, now Pat. No. 11,103,799.

(60) Provisional application No. 62/780,469, filed on Dec. 17, 2018.

(51) Int. Cl.
*A63H 3/04* (2006.01)
*A63H 3/50* (2006.01)

(52) U.S. Cl.
CPC ..... *A63H 3/04* (2013.01); *A63H 3/50* (2013.01)

(58) Field of Classification Search
CPC ..... A63H 3/04; A63H 3/50
USPC ..... 446/370, 373, 374, 376, 382
See application file for complete search history.

(56) References Cited

U.S. PATENT DOCUMENTS 280,986 A 7/1883 Wishard
593,592 A 11/1897 Lyons
1,189,585 A 7/1916 Kruse
1,364,881 A 1/1921 Koch
1,409,411 A 3/1922 Rogers
1,422,840 A * 7/1922 De Grasse ..... A63H 3/04 43/42.26
1,551,250 A 8/1925 Henry
1,590,898 A 6/1926 McAuley
1,591,661 A 7/1926 Dinsdale
(Continued)

FOREIGN PATENT DOCUMENTS

CN 1304327 A 7/2001
EP 1108454 A1 6/2001
KR 200437519 Y1 12/2007

OTHER PUBLICATIONS

Hun Gil Lee Korean Intellectual Property Office, International Search Report and Written Opinion, corresponding PCT Application No. PCT/US2019/064419, dated Mar. 31, 2020, 12 pages total.
(Continued)

*Primary Examiner* — Joseph B Baldori
(74) *Attorney, Agent, or Firm* — DiBerardino McGovern IP Group LLC

(57) ABSTRACT

A posable toy figure is disclosed. The posable toy figure includes: a limb structure comprising a flexible support member at least partially enclosed in a pliable material member that is physically distinct from the flexible support member; a first rigid body member that encloses a first portion of the limb structure, the first rigid body member comprising a connection interface that extends from an exterior of the first rigid body member; and a second rigid body member that encloses a second portion of the limb structure, the second rigid body member and the first rigid body member being spatially separated such that the limb structure is exposed between the first body member and the second body member.

20 Claims, 3 Drawing Sheets

(56) References Cited

U.S. PATENT DOCUMENTS

| | | | | | |
|---|---|---|---|---|---|
| 1,925,895 | A * | 9/1933 | Biber | A63H 9/00 | D21/613 |
| 2,017,023 | A | 10/1935 | Rendle | | |
| 2,073,723 | A | 3/1937 | Woolnough | | |
| 2,109,422 | A | 2/1938 | Haughton | | |
| 2,219,130 | A | 10/1940 | Herrmann | | |
| 2,392,024 | A | 1/1946 | Couri | | |
| 2,535,818 | A | 12/1950 | Smalley | | |
| 2,601,740 | A | 7/1952 | Schippert | | |
| 2,684,503 | A | 7/1954 | Silver | | |
| 3,277,601 | A | 10/1966 | Ryan | | |
| 3,284,947 | A | 11/1966 | Dahl | | |
| 3,325,939 | A | 6/1967 | Ryan et al. | | |
| 3,395,484 | A | 8/1968 | Smith | | |
| 3,574,968 | A * | 4/1971 | Schlau | A63H 9/00 | 425/DIG. 57 |
| 3,624,691 | A | 11/1971 | Robson et al. | | |
| 3,716,942 | A | 2/1973 | Garcia et al. | | |
| 3,807,086 | A | 4/1974 | Schleich | | |
| 3,955,309 | A | 5/1976 | Noble | | |
| 4,123,872 | A | 11/1978 | Silva | | |
| 4,136,484 | A | 1/1979 | Abrams | | |
| 4,233,775 | A | 11/1980 | Neufeld | | |
| 4,470,784 | A | 9/1984 | Piotrovsky | | |
| 4,932,919 | A | 6/1990 | Shapero | | |
| 4,954,118 | A | 9/1990 | Refabert | | |
| 4,964,836 | A | 10/1990 | Kamei | | |
| 5,350,333 | A | 9/1994 | Croyle | | |
| 5,516,314 | A | 5/1996 | Anderson | | |
| 5,630,745 | A | 5/1997 | Yeh | | |
| 5,741,140 | A * | 4/1998 | Bristol | B44C 3/06 | 446/374 |
| 5,762,531 | A | 6/1998 | Witkin | | |
| 5,800,242 | A | 9/1998 | Clokey | | |
| 5,931,560 | A * | 8/1999 | Hoffman | F21V 21/145 | 362/208 |
| 6,155,904 | A | 12/2000 | Spector | | |
| 6,217,406 | B1 | 4/2001 | Ross | | |
| 6,220,922 | B1 | 4/2001 | Lee et al. | | |
| 6,612,896 | B1 | 9/2003 | Choi | | |
| 6,746,303 | B2 | 6/2004 | Beidokhti | | |
| 6,790,398 | B1 | 9/2004 | Ejima et al. | | |
| 6,800,016 | B2 | 10/2004 | Wittenberg et al. | | |
| 6,817,921 | B2 | 11/2004 | Chin et al. | | |
| 7,077,717 | B2 | 7/2006 | Cheng et al. | | |
| 7,473,156 | B2 | 1/2009 | Hsieh | | |
| 7,479,054 | B2 | 1/2009 | Wittenberg et al. | | |
| 7,566,256 | B2 | 7/2009 | Wai | | |
| 8,282,439 | B2 | 10/2012 | Han | | |
| 9,028,292 | B2 | 5/2015 | Benecke et al. | | |
| 9,861,903 | B1 | 1/2018 | Mariasov | | |
| 9,919,230 | B2 | 3/2018 | Li et al. | | |
| 2003/0027488 | A1 | 2/2003 | Langton | | |
| 2004/0266315 | A1 | 12/2004 | Ejima et al. | | |
| 2005/0037686 | A1 | 2/2005 | Wittenberg et al. | | |
| 2005/0274866 | A1 | 12/2005 | Hsieh | | |
| 2016/0228781 | A1 | 8/2016 | Duling et al. | | |
| 2020/0188805 | A1 * | 6/2020 | Boyce | A63H 3/04 | |

OTHER PUBLICATIONS

China National Intellectual Property Administration, Notification of First Office Action, corresponding CN Application No. 201980081033.4, dated Aug. 19, 2022, 22 pages total, (including English translation of 13 pages).

Peter Lucas, European Patent Office, Extended European Search Report in counterpart European Patent Application No. 19897793.6, dated Oct. 19, 2022, 7 pages total.

* cited by examiner

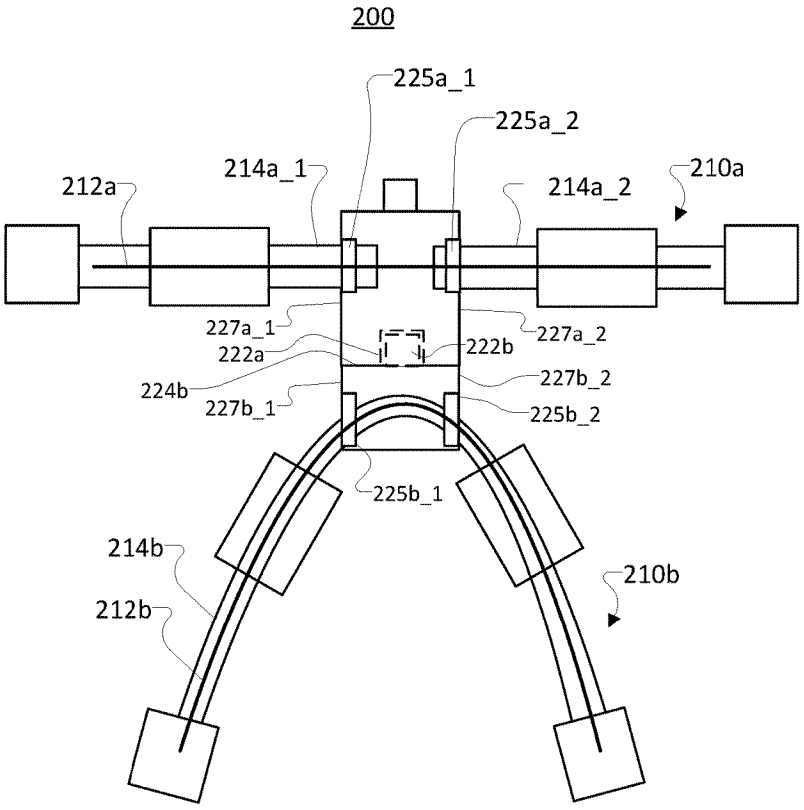
FIG. 2B
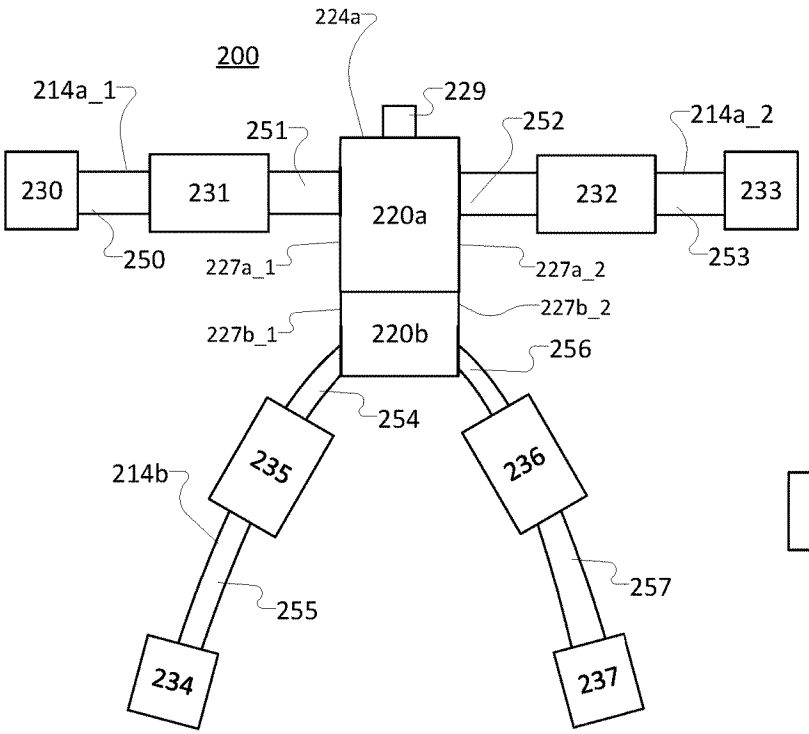
FIG. 2A
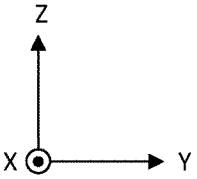

POSABLE TOY FIGURE

CROSS-REFERENCE TO RELATED APPLICATION

This application is a divisional of U.S. patent application Ser. No. 16/702,945, filed on Dec. 4, 2019 and titled POSABLE TOY FIGURE, which claims the benefit of U.S. Provisional Application No. 62/780,469, filed on Dec. 17, 2018 and titled POSABLE TOY FIGURE, both of which are incorporated herein by reference in its entirety.

TECHNICAL FIELD

This disclosure relates to a posable toy figure.

BACKGROUND

Persons of all ages enjoy playing with toys.

SUMMARY

In one aspect, a toy figure comprises: a pelvis body comprising: a first leg opening; a second leg opening; and a first connection interface extending outward from the pelvis body; a torso body comprising: a first arm opening; a second arm opening; and a second connection interface configured to connect to the first connection interface to thereby connect the pelvis body and the torso body; a first flexible wire element that passes through the first leg opening and the second leg opening; a second flexible wire element that passes through the first arm opening and the second arm opening; a first pliable material member that encloses at least a portion of the first flexible wire element, the first pliable material member passing through the first leg opening and the second leg opening; a second pliable material member that encloses at least a portion of the second flexible wire element, the second pliable material member passing through the first arm opening and the second arm opening; and a plurality of rigid body members, each of the rigid body members surrounding a portion of the first pliable material member and the first flexible wire element or a portion of the second pliable material member and the second flexible wire element, and each of the rigid body members being spatially distinct such that at least some other portions of the first pliable material member and some other portions of the second pliable material member are exposed.

Implementations may include one or more of the following features. The first flexible wire element may be a unitary piece. The second flexible wire element may be a unitary piece.

The first pliable material member and the second pliable material member may be made of a flexible fabric material.

The first pliable material member and the second pliable material member may be made of rubber.

Each of the first pliable material member and the second pliable material member may be hollow and substantially cylindrical.

The first pliable material member may be a single piece of flexible fabric, and the second pliable material member may be a separate single piece of flexible fabric.

In some implementations, at least one of the first pliable material member and the second pliable material member comprise more than one piece of pliable material.

The first connection interface may be a spherical operative surface, and the second connection interface may be a spherical recess configured to receive and hold the spherical operative surface.

The first connection interface and the second connection interface may connect via a snap connection.

In some implementations, each of the plurality of rigid body members comprises a first body portion permanently joined to a second body portion.

The torso body also may include a third connection interface that extends from the torso body, the third connection interface being configured to receive a head for the toy figure.

In another aspect, a method of making a toy figure comprises: enclosing at least part of a flexible support element in a pliable material member to form a posable limb structure; capturing a first portion of the posable limb structure in a first rigid body portion such that the first portion of the posable limb structure is within the first rigid body portion and two ends of the posable limb structure extend from different sides of the first rigid body portion; and capturing at least a second portion of the posable limb structure in a second rigid body portion such that a third portion of the posable limb structure is exposed, the third portion of the posable limb portion being between the first rigid body portion and the second rigid body portion.

Implementations may include one or more of the following features. The first rigid body portion may be formed by permanently joining two or more distinct pieces prior to capturing the first portion of the posable limb structure in the first rigid body portion. The method may include forming the second rigid body portion by permanently joining two or more distinct pieces prior to capturing the second portion of the posable limb structure in the second rigid body portion. Permanently joining two or more distinct pieces may include sonically welding the two or more pieces to each other. The method may include molding the first rigid body portion.

In another aspect, a toy figure comprises: a limb structure comprising a flexible support member at least partially enclosed in a pliable material member that is physically distinct from the flexible support member; a first rigid body member that encloses a first portion of the limb structure, the first rigid body member comprising a connection interface that extends from an exterior of the first rigid body member; and a second rigid body member that encloses a second portion of the limb structure, the second rigid body member and the first rigid body member being spatially separated such that the limb structure is exposed between the first body member and the second body member.

Implementations may include one or more of the following features. The flexible support member may be a wire. The wire may be a single-piece wire that passes through the first rigid body member and the second rigid body member.

The techniques discussed herein may be implemented as a toy figure, a toy set that includes a toy figure, or a method of manufacturing or using a toy figure.

DRAWING DESCRIPTION

FIG. 2A is a side block diagram of an exterior of an example of an assembled posable figure.

FIG. 2B is a cross-sectional view of the posable figure of FIG. 2A.

DETAILED DESCRIPTION

A posable toy figure is disclosed. The posable figure includes some aspects that are rigid and some aspects that are flexible. The user is able to manually manipulate the toy figure into a pose, and the toy figure maintains that pose until the pose is deliberately changed.

Figure 1A:
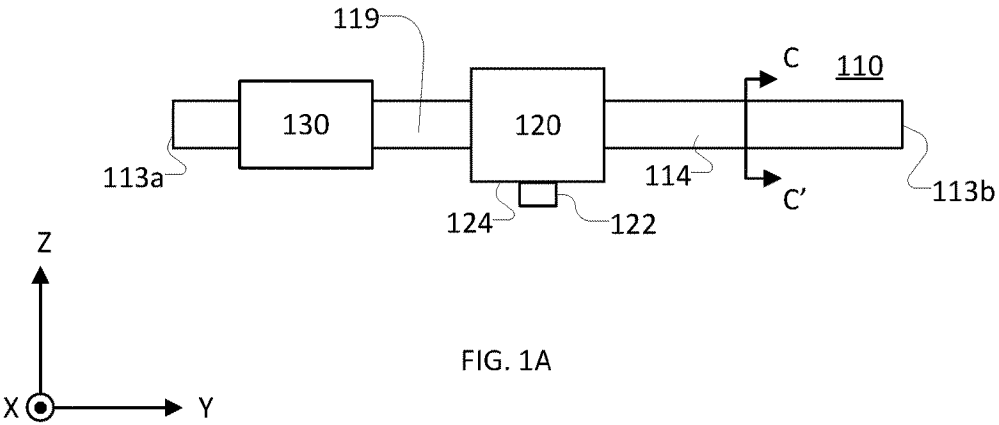
FIG. 1A is a side block diagram of an exterior of an example of a limb structure in an Y-Z plane.
Figure 1B:
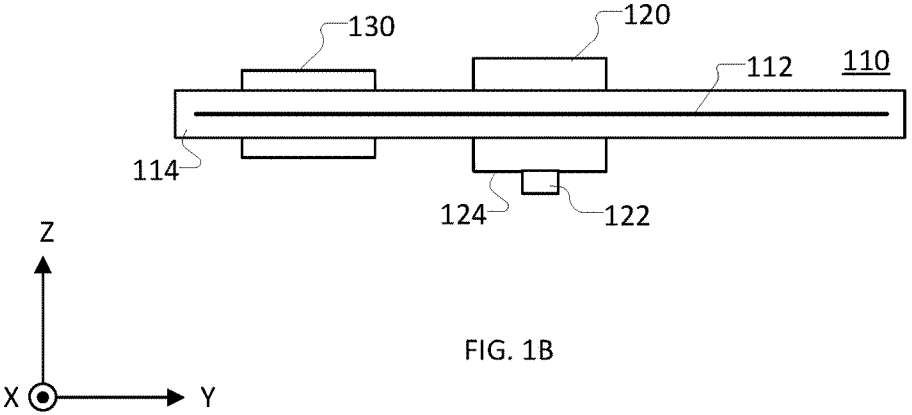
FIG. 1B is a side cross-sectional view of the limb structure of FIG. 1A in an Y-Z plane.
Figure 1C:
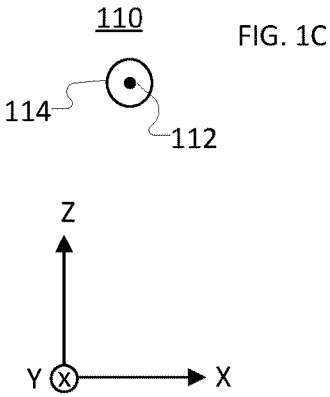
FIG. 1C is a side cross-sectional view of the limb structure of FIG. 1A along the line C-C' of FIG. 1A.

FIG. 1A is a side block diagram of an exterior of an example of a limb structure 110 in the Y-Z plane. FIG. 1B is a side cross-sectional view of the limb structure 110 in the Y-Z plane. FIG. 1C is a side cross-sectional view of the limb structure 110 along the line C-C' of FIG. 1A and in the X-Z plane. FIGS. 1A-1C are referred to in the discussion below.

The limb structure 110 may be used to form a posable toy figure (such as the toy FIG. 200 shown in FIGS. 2A and 2B). The limb structure 110 includes a flexible support member 112 that is enclosed in a pliable member 114. The flexible support member 112 is made from any rugged material that may be repeatedly bent into different shapes without breaking or wearing. For example, the flexible support member 112 may be a metal wire, such as an iron and/or stainless steel wire.

The pliable member 114 is made of any material that is capable of enclosing the flexible support member 112. For example, the pliable member 114 may be made of rubber, flexible polyvinyl chloride (PVC), or a flexible fabric material. The pliable member 114 may be a tube structure or a hollow cylinder. The pliable member 114 may be open at an end 113*a* and/or an end 113*b*. In implementations in which the pliable member 114 is open at the end 113*a* and/or the end 113*b*, the pliable member 114 encloses the flexible member 112 by encircling the flexible member 112. Moreover, the pliable member 114 may enclose the flexible member 112 by enclosing or surrounding less than all of the flexible member 112. In other words, the pliable member 114 is not required to surround the entire flexible member 112. Although the pliable member 114 is able to move with the flexible member 112 and may touch the flexible member 112 as the member 112 moves, as shown in FIG. 1C, the pliable member 114 is separate and distinct from the flexible member 112. For example, the pliable member 114 is not a coating that is permanently part of the flexible member 112.

Figure 1D:
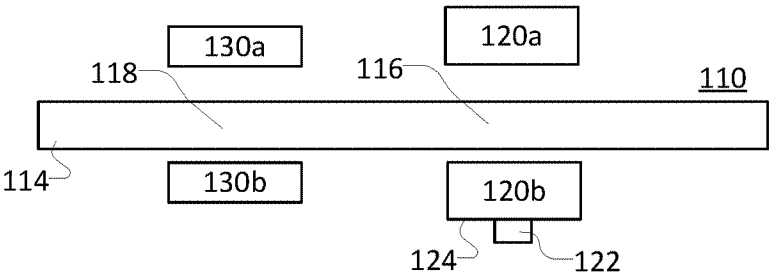
FIG. 1D shows a first rigid body and a second rigid body prior to attachment to the limb structure of FIG. 1A.

The limb structure 110 also includes a first rigid body 120 and a second rigid body 130. The first rigid body 120 and the second rigid body 130 are hollow bodies that enclose respective portions 116, 118 of the pliable member 114. FIG. 1D shows the first rigid body 120 and the second rigid body 130 prior to attachment to the limb structure 110. The first rigid body 120 includes shell parts 120*a*, 120*b* and the second rigid body 130 includes shell parts 130*a*, 130*b*. Each of the shell parts 120*a*, 120*b*, 130*a*, 130*b* is made of a durable and rigid solid material, such as, for example, molded plastic or metal. The shell parts 120*a*, 120*b*, 130*a*, 130*b* are shaped such that when the shell part 120*a* is joined to the shell part 120*b*, a hollow rigid body (the first rigid body 120) is formed. Similarly, when the shell part 130*a* and the shell part 130*b* are joined they form a hollow rigid body (the second rigid body 130).

To attach the rigid bodies 120 and 130 to the limb structure 110, the shell parts 120*a*, 120*b* and the shell parts 130*a*, 130*b* are moved toward each other and toward the limb structure 110. The first portion 116 of the limb structure 110 is captured between the shell parts 120*a* and 120*b*. The second portion 118 of the limb structure 110 is captured between the shell parts 130*a* and 130*b*. The shell parts 120*a* and 120*b* are joined while the first portion 116 is captured between the parts 120*a* and 120*b* to form the first rigid body 120. The shell parts 130*a* and 130*b* are joined while the second portion 118 is captured between the parts 130*a* and 130*b* to form the second rigid body 130. The shell parts 120*a* and 120*b*, and the shell parts 130*a* and 130*b* may be joined to each other by, for example, sonic or ultrasonic welding, gluing, or any other joining technique that creates a permanent bond.

The first rigid body 120 and the second rigid body 130 are separate and distinct rigid bodies and at least part of the pliable member 114 is exposed and visible from the exterior of the limb structure 110 after the first rigid body 120 and the second rigid body 130 are attached to the limb structure 110. In FIG. 1A, the portion labeled as 119 is an example of a part of the pliable member 114 is that is exposed when the first rigid body 120 and the second rigid body 130 are attached to the limb structure 110. The portion 119 is between the first rigid body 120 and the second rigid body 130.

The rigid bodies 120 and 130 do not change shape after being attached to the limb structure 110. The limb structure 110 does not bend at the portions 116 and 118, which are the portions that are captured by the rigid bodies 120 and 130, respectively. However, portions of the limb structure 110 that are not enclosed in the rigid body 120 or the rigid body 130 can change shape after the rigid bodies 120 and 130 are attached. For example, the portion 119 may be bent by a user while the rigid bodies 120 and 130 are attached to the limb structure 110. The user may grasp the limb structure 110 at each of ends 113*a* and 113*b* and cause the limb structure 110 to bend by changing the straight (zero angle) form of the portion 119 shown in FIG. 1A to a non-zero angle. The portion 119 maintains the bent shape after the user stops applying force. In this way, the limb structure 110 is posable.

The first rigid body 120 also includes a connection interface 122 that extends from an exterior surface 124 of the first rigid body 120. The connection interface 122 allows the limb structure 110 to connect to a separate body portion (not shown in FIG. 1A) to form a toy figure such as the toy FIG. 200 of FIGS. 2A and 2B. The connection interface 122 may be, for example, a ball connection or a post that connects to a corresponding socket on the separate body portion. Because the connection interface 122 extends outward from the surface 124, the connection interface 122 occupies little to no space in the interior of the first rigid body 120. Thus, the limb structure 110 may be connected to another structure to form a larger posable figure (such as the FIG. 200 of FIGS. 2A and 2B), but the interior of the first rigid body 120 has enough space to enclose the first portion 116 of the limb structure 110. The external arrangement of the connection interface 122 allows the first rigid body 120 to be a relatively small element, thereby providing for more design options for the posable figure.

Referring to FIG. 2A, a side block diagram of an exterior of an example of an assembled posable FIG. 200 is shown. FIG. 2B shows a cross-sectional view of the posable FIG. 200. The assembled posable FIG. 200 includes two limb structures 210*a* and 210*b*. Each limb structure 210*a*, 210*b* is similar to the limb structure 110 of FIGS. 1A-1D.

The toy FIG. 200 is a humanoid action figure. The toy FIG. 200 includes a torso body 220*a* and a pelvis body 220*b*, both of which are hollow rigid bodies. The pelvis body 220*b* includes a connection interface 222*b* that is received and held by a corresponding connection interface 222*a*. The connection interface 222*a* is part of the torso body 220*a*. The connection interface 222*b* extends outward from an exterior surface 224*b* of the pelvis body 220*b*. The connection interface 222*a* is recessed into the torso body 220*a*. The torso body 220*a* also includes an additional connection interface 229 that is used to connect an external feature such as, for example, a head element (not shown) to the toy FIG. 200. The additional connection interface 229 may be a post or ball that extends outward from an external surface 224*a* the torso body 220*a*.

As compared to a connection interface that protrudes into the pelvis body 220*b*, the connection interface 222*b* allows more space in the interior of the pelvis body 220*b*. The arrangement and configuration of the connection interfaces 222*a* and 222*b* allow the pelvis body 220*b* to be relatively small, and smaller than the torso body 220*a*. This provides the opportunity for a more realistic design for the pelvis body 220*b*.

The connection interface 222*a* and the connection interface 222*b* may form a snap connection. For example, the connection interface 222*b* may be a ball and the connection interface may be a socket that includes an opening that is a partial sphere. In these implementations, the ball snaps into the spherical opening. In other implementations, the connection interface 222*a* and the connection interface 222*b* form a friction fit connection. Regardless of the type of connection formed by the interfaces 222*a* and 222*b*, the pelvis body 220*b* and the torso body 220*a* are connected at the point of manufacture and are intended to remain connected during use. However, the pelvis body 220*b* and the torso body 220*a* may be rotatable relative to each other.

The torso body 220*a* includes arm openings 225*a*_1 and 225*a*_2. The arm openings 225*a*_1 and 225*a*_2 pass through respective sidewalls of the torso body 220*a*. The arm opening 225*a*_1 is formed in a first sidewall 227*a*_1, and the arm opening 225*a*_2 is formed in a second sidewall 227*a*_2 that is opposite to the sidewall 227*a*_1. A flexible support member 212*a* passes through the torso body 220*a*, with one end of the flexible support member 212*a* passing through each of the arm openings 225*a*_1, 225*a*_2. The flexible support member 212*a* is any flexible and durable material that is capable of being repeatedly shaped and holding that shape. For example, the flexible support member 212*a* may be a metal wire.

A portion of the flexible support member 212*a* is enclosed by a pliable member 214*a*_1, and another portion of the flexible support member 212*b* is enclosed by a pliable member 214*a*_2. Together, the flexible member 212*a*, and the pliable members 214*a*_1 and 214*a*_2 form the limb structure 210*a*. The pliable member 214*a*_1 extends through the arm opening 225*a*_1, and the pliable member 214*a*_2 extends through the arm opening 225*a*_2. The arm openings 225*a*_1, 225*a*_2 are sized such that the respective pliable members 214*a*_1, 214*a*_2 remain in the arm openings 225*a*_1, 225*a*_2 during ordinary use.

The pliable members 214*a*_1 and 214*a*_2 are made of any flexible material capable of enclosing the flexible support member 212*a*. For example, the pliable members 214*a*_1 and 214*a*_2 may be made from rubber or a flexible fabric material. The pliable members 214*a*_1 and 214*a*_2 are distinct and separate from the flexible member 212*a*. However, the pliable members 214*a*_1 and 214*a*_2 are able to move with the flexible support member 212*a* but do not rip or break when the flexible support member 212*a* moves. In the example toy FIG. 200, the pliable members 214*a*_1 and 214*a*_2 are separate pliable members that do not touch each other within the torso body 220*a*. However, in other implementations, a single, unitary pliable member that passes through both arm openings 225*a*, 225*b* and encloses the flexible support member 212*a* is used instead of the pliable members 214*a*_1 and 214*a*_2.

The toy FIG. 200 also includes the pelvis body 220*b*. The pelvis body 220*b* includes leg openings 225*b*_1 and 225*b*_2 that pass through respective sidewalls 227*b*_1 and 227*b*_2. Each end of a flexible support member 212*b* passes through one of the leg openings 225*b*_1, 225*b*_2. The flexible support member 212*b* is any flexible element that can be shaped repeatedly without breaking and is able to maintain a formed shape until being intentionally re-shaped. For example, the flexible support member 212*b* may be a metal wire.

The flexible support member 212*b* is enclosed by a pliable member 214*b*. The pliable member 214*b* is a unitary pliable member. One end of the pliable member 214*b* extends through each of the leg openings 225*b*_1, 225*b*_2. Together, the pliable member 214*b* and the flexible member 212*b* form the limb structure 210*b*.

The toy FIG. 200 also includes hollow rigid body members 230-237, each of which is a separate and distinct body member. Each of the body members 230-237 is similar to the second rigid body 130 (FIGS. 1A, 1B, and 1D). Thus, each of the body members 230-237 is formed from at least two shell portions. Each of the rigid body members 230-233 encloses a portion of the limb structure 210*a*. Each of the rigid body members 234-237 encloses a portion of the limb structure 210*b*. Portions 250 and 251 of the pliable member 214*a*_1, portions 252 and 253 of the pliable member 214*a*_2, and portions 255-258 of the pliable member 214*b* are exposed when the toy FIG. 200 is fully assembled. The toy FIG. 200 may be bent at any of the portions 250-257 because these portions are not in a rigid body. In this way, the toy FIG. 200 is posable.

The toy FIG. 200 may have additional features. For example, the body members 234 and 237 may be sized in the X direction such that the toy FIG. 200 is able to stand upright (along the Z direction in this example). Moreover, one or more of the sides of the body members 234 and 237 may be beveled to provide for enhanced posing in the upright position.

Figure 3:
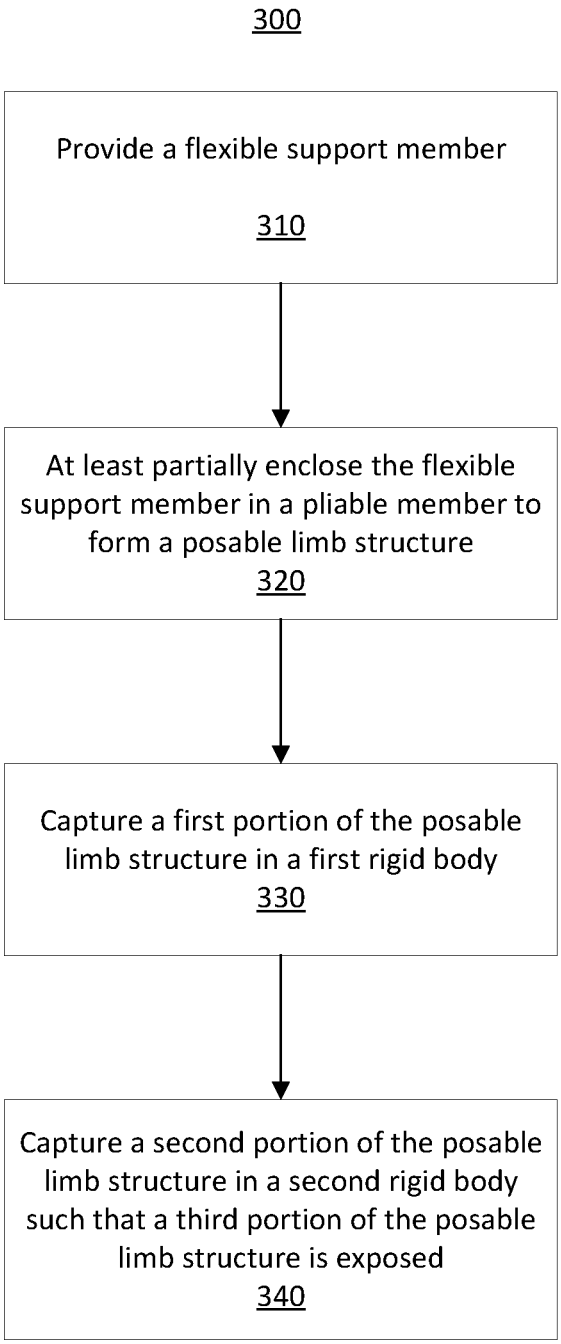
FIG. 3 is a flow chart of an example of a process for manufacturing a limb structure

FIG. 3 is a flow chart of an example of a process 300 for manufacturing a limb structure that may be used as part of a toy figure, such as the toy FIG. 200 (FIGS. 2A and 2B). The process 300 is discussed with respect to the limb structure 110 of FIGS. 1A-1D.

The flexible support member 112 is provided (310). The flexible support member 112 is at least partially enclosed in the pliable member 114 to form the limb structure 110 (320). For example, in some implementations, the pliable member 114 is a tube and the flexible support member 112 is enclosed in the pliable member 114 by inserting the flexible member 112 into an end of the tube. In some implementations, the flexible support member 112 is placed in a mold, and the pliable member 114 is formed by injecting a pliable material into the mold. In these implementations, the flexible support member 112 is overmolded.

The portion 116 of the posable limb structure 110 is captured in the first rigid body 120 (330). In some implementations, and as shown in FIG. 1D, the rigid body 120 includes two shell parts 120*a* and 120*b*. The shell parts 120*a* and 120*b* are initially separated from each other along the Z direction. To capture the portion 116 in the body 120, the shell parts 120*a* and 120*b* are aligned with each other along the Z direction. The shell parts 120*a* and 120*b* are moved toward each other and toward the portion 116 until the shell parts 120*a* and 120*b* touch each other and capture the portion 116 between the shell parts 120*a* and 120*b*. The shell parts

120*a* and 120*b* are permanently joined to each other by any technique capable of forming a permanent bond between the shell part 120*a* and the shell part 120*b*. In implementations in which the shell parts 120*a* and 120*b* are made of plastic, ultrasonic welding may be used to create the permanent bond. Ultrasonic welding includes applying pressure to the shell parts 120*a* and 120*b* and then applying ultrasonic acoustic vibrations to the shell parts 120*a* and 120*b* to create a solid-state weld that permanently joins the shell parts 120*a* and 120*b*.

The portion 116 may be captured in the first rigid body 120 in another manner. For example, the first rigid body 120 may be pre-formed as a unitary hollow body with two openings. In these implementations, the limb structure 110 is passed through both openings until the portion 116 is within the first rigid body 120. Moreover, in some implementations, the first rigid body 120 is a molded hollow piece. In implementations that include more shells that are permanently joined to the form the first rigid body 120, each of the shells may be a molded piece.

The portion 118 is captured in the second rigid body 130 (340). In some implementations, and as shown in FIG. 1D, the rigid body 130 includes two shell parts 130*a* and 130*b*. The shell parts 130*a* and 130*b* capture the portion 118 and are permanently bonded. The shell parts 130*a* and 130*b* may be permanently bonded in a manner similar to the manner in which the shell parts 120*a* and 120*b* are connected. In other implementations, the second rigid body 130 is pre-formed and the portion 118 is captured in the second rigid body member by passing the limb structure 110 into an opening in the second rigid body 130.

In some implementations, additional rigid bodies are attached to the limb structure 110. However, regardless of how many rigid bodies are attached, the limb structure 110 includes portions (such as the portion 119) that are not covered or captured by a rigid body. The limb structure 110 is able to bend at the portions that are not captured by a rigid body and is thus posable.

In some implementations, the rigid body 120 is connected to another rigid body (such as the torso element 220*a* of FIGS. 2A and 2B) to form a toy figure that has a humanoid appearance. The toy figure may have a form other than a humanoid. For example, the toy figure may resemble a vehicle, an insect, an animal.

Other implementations are within the scope of the claims.

What is claimed is:

1. A method of making a toy figure, the method comprising:

enclosing at least part of a flexible support element in a pliable material member to form a posable limb structure;

capturing a first portion of the posable limb structure in a first rigid body portion such that the first portion of the posable limb structure is within the first rigid body portion and the posable limb structure extends outward from different sides of the first rigid body portion;

capturing at least a second portion of the posable limb structure in a second rigid body portion such that a third portion of the posable limb structure is exposed, the third portion of the posable limb portion being between the first rigid body portion and the second rigid body portion; and inserting a connection interface that extends from an exterior surface of the first rigid body portion into a recess in a third rigid body portion to connect the first rigid body portion to the third rigid body portion.

2. The method of claim 1, further comprising forming the first rigid body portion by permanently joining two or more distinct pieces.

3. The method of claim 2, wherein permanently joining two or more distinct pieces comprises sonically welding the two or more pieces to each other.

4. The method of claim 1, further comprising forming the second rigid body portion by permanently joining two or more distinct pieces.

5. The method of claim 1, further comprising molding the first rigid body portion.

6. The method of claim 1, wherein the connection interface that extends from the first rigid body portion comprises a ball, and the recess in the third rigid body portion comprises a socket configured to receive and hold the ball.

7. The method of claim 1, wherein the connection interface that extends from the first rigid body portion snaps into the recess in the third rigid body portion.

8. The method of claim 1, wherein enclosing at least part of a flexible support element in the pliable material comprises placing the pliable material around the flexible support member such that the pliable material is able to move relative to the flexible support member.

9. The method of claim 1, wherein the posable limb structure is a first posable limb structure, and further comprising:

enclosing at least part of a second flexible support element in a second pliable material member to form a second posable limb structure; and capturing a first portion of the second posable limb structure in the third rigid body portion such that the first portion of the second posable limb structure is within the third rigid body portion and the second posable limb structure extends outward from different sides of the third rigid body portion.

10. The method of claim 9, wherein the first rigid body portion comprises a torso body, and the third rigid body portion comprises a pelvis.

11. The method of claim 9, wherein the torso body comprises a plurality of pieces that are permanently joined after capturing the first portion of the first posable limb structure, and the pelvis body comprises a plurality of pieces that are permanently joined after capturing the first portion of the second posable limb structure.

12. The method of claim 11, wherein capturing the first portion of the first posable limb structure comprises:

placing the first portion of the first posable limb structure between two of the pieces, moving the two pieces toward each other until the two pieces touch each other with the first portion between them, and permanently joining the two pieces with the first portion captured between them; and capturing the second portion of the second posable limb structure comprises:

placing the first portion of the second posable limb structure between two of the pieces, moving the two pieces toward each other until the two pieces touch each other with the second portion between them, and permanently joining the two pieces with the first portion captured between them.

13. The method of claim 12, wherein permanently joining the two pieces with the first portion captured between them comprises joining the two pieces with one of sonic welding, and permanently joining the two pieces with the second portion captured between them comprises joining the two pieces with one of sonic welding.

14. The method of claim 1, wherein the toy figure to has a humanoid, vehicle, insect, or animal appearance.

15. A method of making a toy figure, the method comprising:

enclosing at least part of a first flexible support element in a first pliable material member to form a first posable limb structure;

capturing a first portion of the first posable limb structure in a first rigid body portion such that the first portion of the first posable limb structure is within the first rigid body portion and two ends of the first posable limb structure extend from different sides of the first rigid body portion;

capturing at least a second portion of the first posable limb structure in a second rigid body portion such that a third portion of the first posable limb structure is exposed, the third portion of the first posable limb structure being between the first rigid body portion and the second rigid body portion;

enclosing at least part of a second flexible support element in a second pliable material member to form a second posable limb structure;

capturing a first portion of the second posable limb structure in a third rigid body portion such that the first portion of the second posable limb structure is within the third rigid body portion and two ends of the second posable limb structure extend from the third rigid body portion;

capturing at least a second portion of the second posable limb structure in a fourth rigid body portion such that a third portion of the second posable limb structure is exposed, the third portion of the second posable limb structure being between the third rigid body portion and the fourth rigid body portion; and inserting a ball joint that extends from an exterior surface of the third rigid body into and a socket interface recessed into the first rigid body.

16. The method of claim 15, further comprising forming the first rigid body portion by permanently joining two or more distinct pieces.

17. The method of claim 16, wherein permanently joining two or more distinct pieces comprises sonically welding the two or more pieces to each other.

18. The method of claim 17, further comprising molding the two or more distinct portions.

19. A method of making a toy figure, the method comprising:

enclosing at least part of a first flexible support element in a first pliable material member to form a first posable limb structure;

capturing a first portion of the first posable limb structure in a torso body portion such that the first portion of the first posable limb structure is within the torso body portion and two ends of the first posable limb structure extend from different sides of the torso body portion;

capturing at least a second portion of the first posable limb structure in a second rigid body portion such that a third portion of the first posable limb structure is exposed, the third portion of the first posable limb structure being between the torso body portion and the second rigid body portion;

enclosing at least part of a second flexible support element in a second pliable material member to form a second posable limb structure;

capturing a first portion of the second posable limb structure in a pelvis body portion such that the first portion of the second posable limb structure is within the pelvis portion and two ends of the second posable limb structure extend from the pelvis body portion;

capturing at least a second portion of the second posable limb structure in a fourth rigid body portion such that a third portion of the second posable limb structure is exposed, the third portion of the second posable limb structure being between the pelvis body portion and the fourth rigid body portion; and inserting a ball joint that extends from an exterior surface of the pelvis body portion into and a socket interface recessed into the torso body portion.

20. The method of claim 19, wherein the first portion of the first posable limb structure includes a region in which the flexible member is exposed.

* * * * *